US005772509A

United States Patent [19]

Weiss

[11] Patent Number: 5,772,509

[45] Date of Patent: Jun. 30, 1998

[54] INTERACTIVE GAMING DEVICE

[75] Inventor: Steven A. Weiss, Las Vegas, Nev.

[73] Assignee: Casino Data Systems, Las Vegas, Nev.

[21] Appl. No.: 621,223

[22] Filed: Mar. 25, 1996

[51] Int. Cl.[6] ..... A63F 3/06

[52] U.S. Cl. ..... 463/16

[58] Field of Search ..... 463/16–22, 9, 463/10, 40–42; 273/139

[56] References Cited

U.S. PATENT DOCUMENTS 5,193,818 3/1993 Leeson ..... 463/10
5,263,716 11/1993 Smyth ..... 463/21
5,472,194 12/1995 Breeding et al. ..... 463/42
5,628,684 5/1997 Bouedec ..... 463/22

*Primary Examiner*—George Manuel
*Attorney, Agent, or Firm*—Bernhard Kreten

[57] ABSTRACT

An interactive gaming device allowing a dynamic exchange between player and the gaming device including a plurality of first gaming machines all driven by a random number generator and a second gaming means capable of being influenced by any of the players engaged in the first gaming devices upon qualifying, said second gaming device influenced by a random number generator.

23 Claims, 3 Drawing Sheets

INTERACTIVE GAMING DEVICE

FIELD OF THE INVENTION

The following invention relates generally to gaming devices having chance means for wagering where an outcome is influenced by a random number generator. A pay table determines the award a player enjoys based on outcome. Specifically, the instant invention is directed to an interactive gaming system in which a plurality of first gaming machines are influenced by a random number generator. The outcome from the plurality of first gaming machines may allow one or more players at these first gaming machines to participate in a further opportunity to be awarded a prize on a second gaming machine operatively coupled to each of the first gaming machines.

BACKGROUND OF THE INVENTION

Gaming machines, particularly slot machines have become one of the more exciting wagering adventures available at casinos and the like and have also been a source of greater profit for gaming establishments over the last few years, particularly with the advent of "progressive" type machines where a plurality of machines are linked together and a portion of each wager is allocated to a pool defining a relatively larger prize compared to the traditional stand-alone slot machines. While progressive slot machines certainly have increased the popularity of "automated" gaming devices, they do not vary significantly from their predecessors because there is no creative interaction between the player and the machine. Only the magnitude of the prize has increased.

In addition, progressive type machines have an "antisocial" competitive component. Because the pot to be won escalates as a function of many players' activities, the first person to achieve a certain outcome is the winner in a "winner take all" scheme. As a result, playing slot machines is typically an insular and isolated activity.

By contrast, certain table games in casinos include wagering situations that encourage a communal spirit and encourage camaraderie among players during the course of play. For example, in a table game called "craps", one can show support for the person "shooting" the dice by betting on the player to succeed (e.g. pass) and therefore share in the excitement and reward with the "shooter" as the shooter plays.

Interactive video games are commonly found in arcades and at home, but these systems do not involve wagering. However, the interactive video wagering system according to the present invention encourages social intercourse among a plurality of players at first gaming machines who then can provide encouragement and/or simulate rivalry with respect to play at a second gaming machine.

Specific to the gaming industry are several known games using a video screen remote from the betting station. One is a horse race game by Sega that allows several players to sit at individual betting stations (similar to slot machines) and wager on a horse race occurring at predetermined time intervals. A larger screen is placed a short distance away from the betting stations, but it merely displays the same information as the betting station display. Another game is a poker game by P & M Coin that is a pod-like display with up to five players participating in a poker hand at individual betting stations. However, the game is merely interactive between participating players and each betting station has an additional screen display with a dealer. A third game is manufactured by Innovative Gaming Corporation of America (IGCA) and has poker and blackjack hands similar to the P & M Coin Game.

SUMMARY OF THE INVENTION

At this time, no known patent has been granted for a product with linked slot machines placed near a larger video screen displaying a feature different from the slot display with an outcome randomly determined.

The instant invention is directed to an instrumentality and method which can promote a pleasant wagering environment that benefits from peoples' desire to partake in both a social activity and entertainment while amusing themselves when wagering.

For example, one such scenario could involve a plurality of first gaming machines all which have a similar type of award system or pay table, as in conventional slot machines. Typically three reels are disposed in a machine and are allowed to spin such that orientation of certain symbols along a row triggers a payoff whose magnitude is based on a pay table. In another format, these first video gaming machines could simulate a type of poker having a pay table which ranks poker hands. All of these machines are typically "controlled" by a random number generator with respect to subsequent outcomes. That is, subsequent events are due to a random number generator output.

Based upon the occurrence of any prescribed condition(s), these first gaming machines, all of which are in operative communication with a second gaming machine, enable the second gaming machine only upon the occurrence of said specified condition(s). Once the player qualifies to play on the second gaming machine, an opportunity of winning on the second gaming machine exists according to a series of outcomes determined by a random number generator. By witnessing one player's success, all who are in the area of the first gaming machines and video display can perceive the outcome that the one player enjoys when advancing to the second gaming machine level and winning a prize.

OBJECTS OF THE INVENTION

Accordingly, it is an object of the present invention to provide a new and novel interactive wagering system and method.

It is an object of the present invention to provide a system as delineated supra which is extremely enjoyable and increases players gratification by allowing interaction among various players having a common goal.

A further object of the present invention is to provide a device as characterized above which provides greater consumer interest so that gaming establishments can enjoy greater participation.

A further object of the present invention is to provide a device as characterized above which is extremely durable in construction, automated for efficiency and reliable to use.

A further object of the present invention is to provide a device as characterized above which is impartial and provides random outputs for fairness.

A further object of the present invention is to provide a device as characterized above which can reward a player's skill and judgment.

A further object of the present invention is to provide a device as characterized above which also may include a component sometimes defined as luck.

Viewed from a first vantage point, it is an object of the present invention to provide a player interactive gaming device comprising a plurality of player interactive first chance means each having a plurality of outcomes, at least one second chance means coupled to the first chance means and having means to interact with all of the plural players who become eligible to partake in the second chance means based on qualifying via the first chance means, certain of the plurality of outcomes from the plurality of first chance means triggering an input to the second chance means.

Viewed from a second vantage point, it is an object of the present invention to provide a player interactive gaming device comprising a plurality of player interactive first chance means having a plurality of outcomes, at least one second chance means, the plurality of outcomes from the plurality of first chance means includes at least one outcome which serves as an input to enable the second chance means.

Viewed from a third vantage point, it is an object of the present invention to provide a player interactive gaming device, comprising in combination a plurality of gaming machines, the gaming machines electronically coupled together; each the gaming machine having a first gaming event; a second gaming event electronically coupled to the plurality of gaming machines; means to qualify to play the second gaming event by playing at least one of the plurality of gaming machines.

Viewed from a fourth vantage point, it is an object of the present invention to provide a gaming system comprising in combination a plurality of first gaming machines each controlled in their respective outputs by a random number generator means, a second gaming machine coupled to each of the first gaming machines and enabled by any of the first gaming machines upon the occurrence of enabling conditions determined by the random number generator means, and the random number generator means coupled to the second gaming machine to determine the outcome of the second gaming machine.

Viewed from a fifth vantage point, it is an object of the present invention to provide an interactive gaming device comprising, in combination: a plurality of gaming machines; a random number generator operatively coupled to the gaming machines developing outputs dependent upon choices made by a plurality of gaming machine players; means to vary the speed of each of the gaming machines to match the speed of the respective player.

Viewed from a sixth vantage point, it is an object of the present invention to provide an interactive method for altering game play speed of a gaming device, the steps including; establishing a base rate for the gaming device by measuring any interval between when the device responds to the player and when the player responds back to the device; determining whether the interval is substantially constant; altering the base rate if the interval is not constant and then measuring the player's subsequent response interval; determining whether the player's subsequent response interval is constant; continuing to alter the base rate until the player's response interval is substantially constant.

These and other objects will be made manifest when considering the following detailed specification when taken in conjunction with the appended drawing figures.

DESCRIPTION OF PREFERRED EMBODIMENTS

Figure 1:
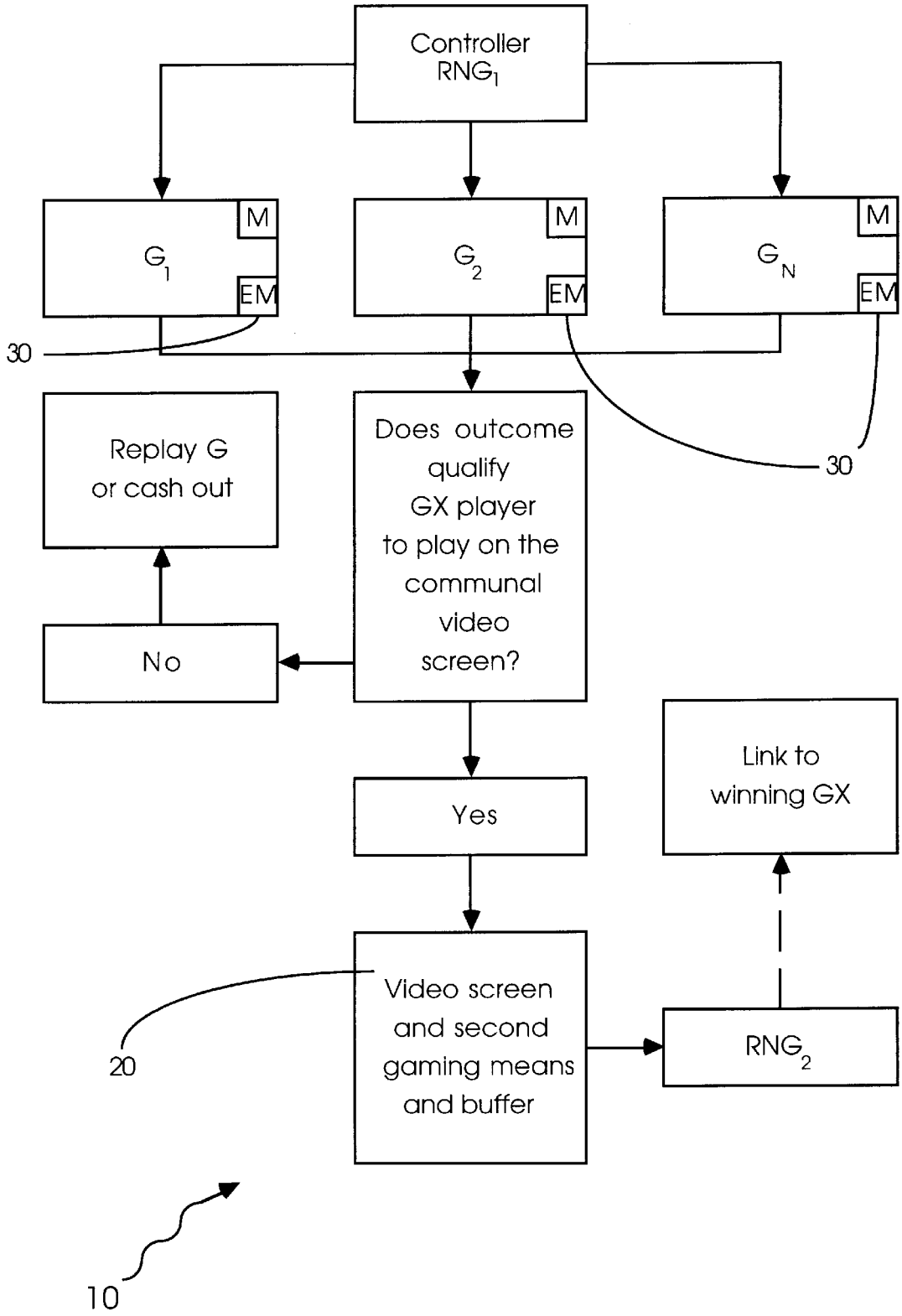
FIG. 1 is a schematic depiction of the invention according to one form.

Referring to the drawings now, wherein like reference numerals denote like parts throughout, reference numeral 10 is directed to the interactive gaming device according to the present invention.

In its essence, and referring to FIG. 1, the interactive gaming device 10 includes a plurality of first gaming means such as machines $G_1$, $G_2$, . . . $G_N$. Each of these gaming machines $G_N$ may embody a conventional or familiar wagering game, such as video poker or a spinning three reel type wagering device known in the art. These first gaming machines $G_N$ are preferably oriented such that they are all controlled by a single controller having a random number generator $RNG_1$ operatively coupled thereto. Thus, the controller which includes the random number generator RNGI is in communication with the plurality of first gaming machines $G_1$, $G_2$, . . . $G_N$ such that players playing any of these machines will have totally impartial, random outputs as a function of stimuli by the random number generator $RNG_1$.

Each of the plurality of first gaming machines has a "pay table" which announces to each player the circumstances surrounding the winning of prizes, the denomination of which vary with respect to the nature of the win. For example, a royal flush in video poker has a different, more desirable award than a pair.

The plurality of first gaming devices also has an output which allows the player to qualify to play on a second gaming means operatively coupled to the plurality of first gaming means $G_1$, $G_2$, . . . $G_N$, the second gaming means preferably being provided with a video screen 20 sufficiently large that all players deployed on the series of first gaming machines $G_1$, $G_2$, . . . $G_N$ have visual access to the video screen 20.

Each of the games $G_1$, $G_2$, . . . $G_N$, are provided with enabling means 30 to control an output with respect to said second gaming means and have it displayed on the video screen 20. For example, FIG. 1 shows enabling means EM 30 disposed in the lower right-hand corner of games $G_1$, $G_2$, . . . $G_N$. Typically, such enabling means may include a push button, joy stick or the like so that any of a variety of choices reflected on the video screen of the second gaming means can be selected. For example, a player whose performance on the first gaming means $G_1$, $G_2$, . . . $G_N$ is adequate to play the second gaming means may be asked to select between one of a series of choices. For example, pick one number one through five. It is envisioned that the video screen 20 and second gaming means can be tailored to compliment the theme of the casino in which it is installed. For example, a casino having a mining theme may have a series of five mine shafts capable of being selected by a qualified player from one game $G_X$. The qualified player picks any one of the five mine shafts and the video screen thereafter depicts a ride down the mine shaft to a source of treasure. This treasure would be displayed by a miner and serve as a bonus award that the qualified player has earned as a result of the player's performance.

In certain circumstances, the award of prizes could conceivably be so frequent that the video screen that is publicly viewable to all players develops a queue of people waiting to play the second gaming means. Since this could represent a significant down time with respect to using the first plurality of gaming machines $G_1$, $G_2$, . . . $G_N$, a plurality of monitors M could be located on each of the gaming machines $G_1$, $G_2$, . . . $G_N$ whereby the individual player who has qualified to play the second gaming means could privately advance through the award associated with the second gaming means via the monitor on the game $G_1$ without a real time public viewing of the event. It may also occur that in such a situation, the video screen circuitry will include means for buffering to store those other bonus events so that during periods of less frenetic activity, the previous awards can be shown on the video screen by way of instant replay, for example.

As shown in FIG. 1, a link to a winning game $G_X$ provides input to a second random number generator $RNG_2$ to drive the second gaming means depicted on the video screen whereby this link allows the player to select the preferred mine shaft. It should also be observed that a single random number generator could be tailored to perform the functions of $RNG_1$ and $RNG_2$.

Figure 2:
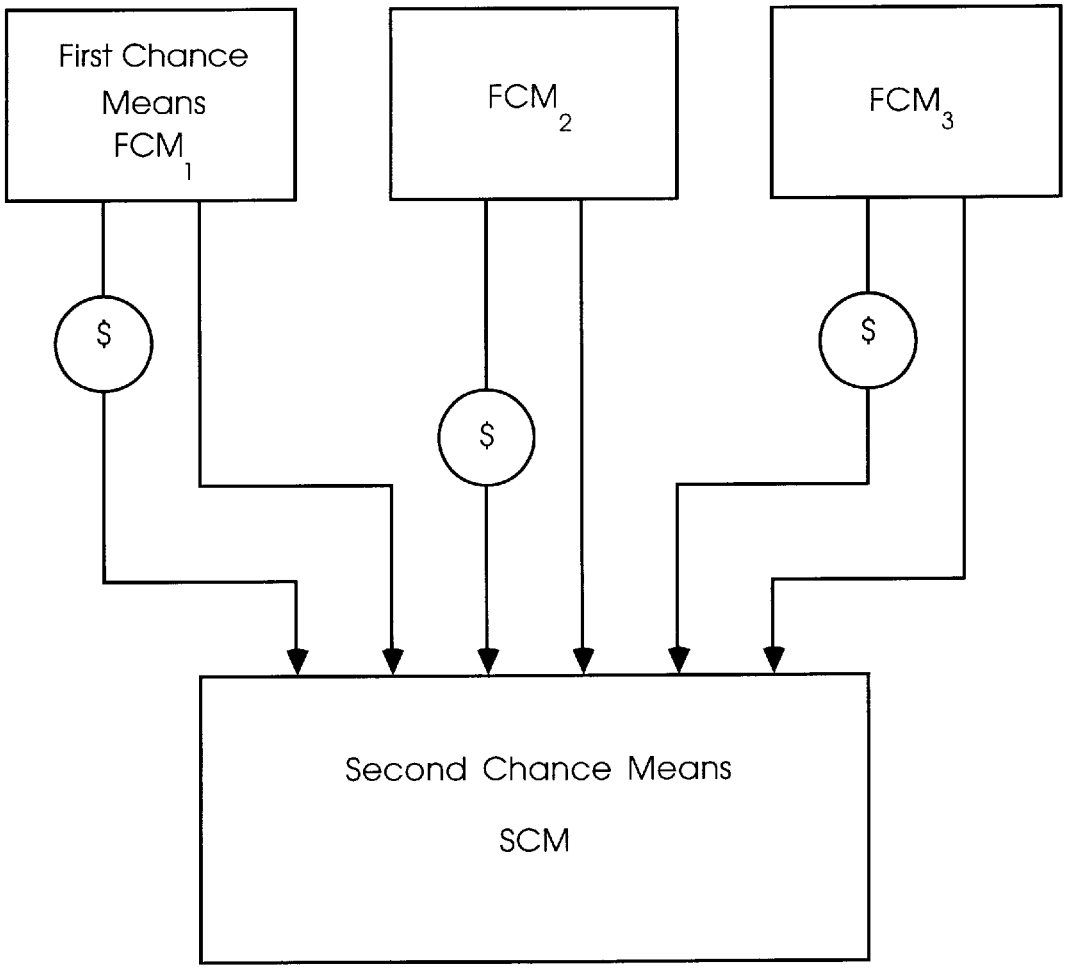
FIG. 2 is a second schematic depiction according to another form of the invention.

In another form of the invention, the video screen could depict a second chance means, such as a horse race in which the ability of one of the player's horses to perform is directly correlative to the input from a first chance means. For example, in FIG. 2, assume that the plurality of first chance means $FCM_1$, $FCM_2$, . . . $FCM_N$ is a form of video poker. The first chance means $FCM_1$, $FCM_2$, . . . $FCM_N$ would then provide weighted stimulus to the second chance means SCM so that a person with a royal flush would have a horse advance more quickly around a race course than a player whose first chance means show only an Ace high hand. In such a scenario, it may also be possible for the players at the first chance means to make wagers in the second chance means with respect to an outcome on the second chance means which, in this example would culminate with a horse identified with a player at the first chance means having won the race.

Figure 3:
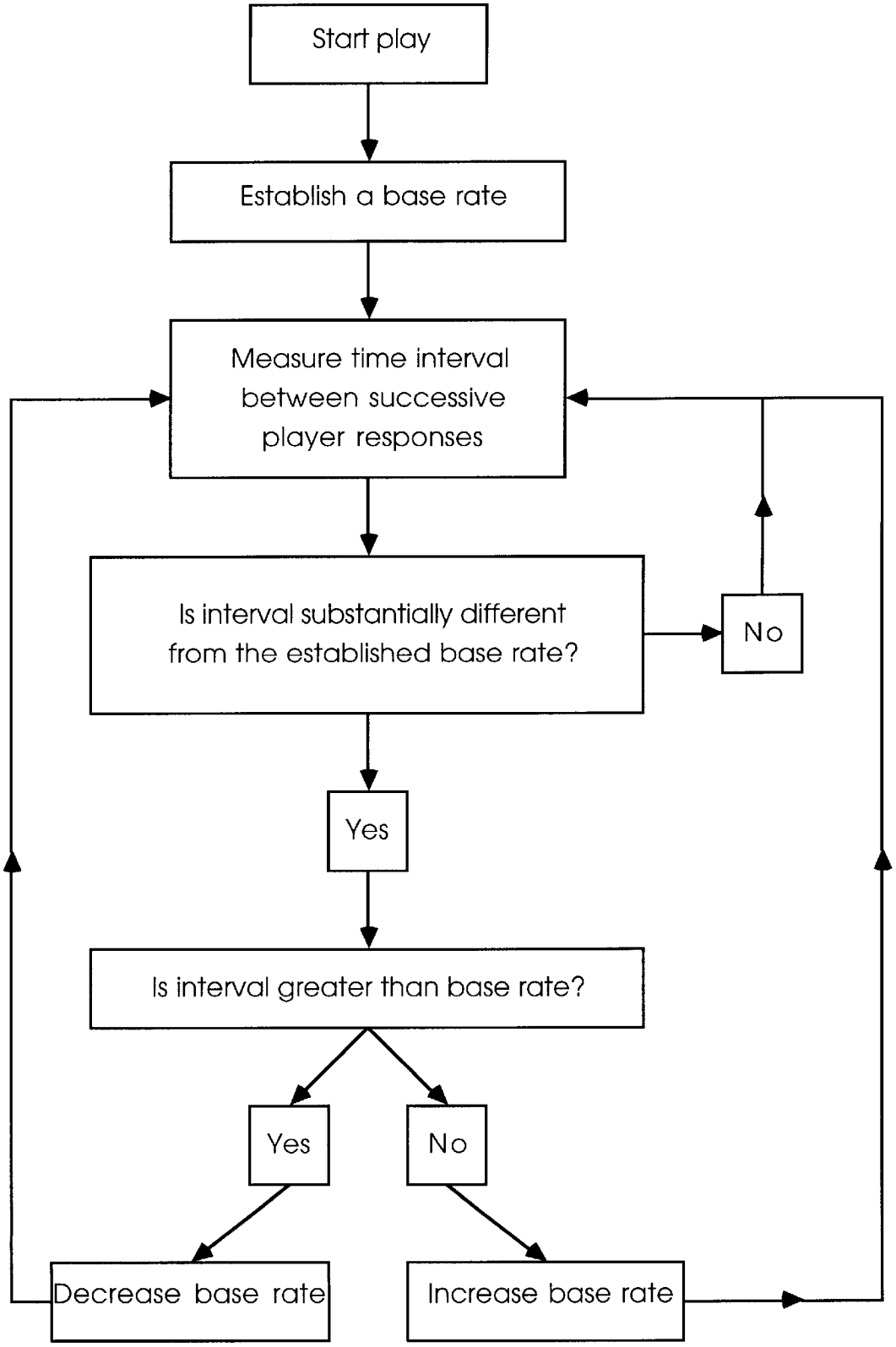
FIG. 3 is a third schematic depiction of an aspect of the invention.

Considering FIG. 3, it is thereshown a method by which the speed of the machine can be modified to match the speed at which the player desires to play the device. It should be observed that not infrequently, the speed at which the machine provides stimuli to the player in the past has not kept pace with the speed at which a player prefers to play. A situation such as this is especially acute during "tournament" or "match" play where the player is competing with other players for prizes and the machine operates at a speed considerably slower than the rate at which the player prefers to proceed. To offset this problem, as shown in FIG. 3, once play has been started, a base rate is established which can be derived from statistical observations with respect to the normal rate at which a player wishes stimuli from the machine. Once a base rate has been established, the machine measures the time interval between when the machine responds to a player and how long it takes for the player to respond back to the machine. This in effect correlates to the attention or mental acuity that the player desires to devote to the machine per se. As with the statistically derived initial base rate, the player's successive response time intervals can be averaged over a number of games or subjected to other statistical normalization. If the player is responding more quickly to the machine than the established base rate, then the base rate is increased so that the machine can keep pace with the player. Conversely, if the player is responding less quickly than the rate at which the machine stimulates the player, then the base rate will be decreased to keep pace with the player. In this manner, the interval between when the machine responds to the player and when the player responds back to the machine will maintain a substantially constant rate so that the player and the machine will have interacted to match the playing style of the player. In some instances, it may be desirable to increase the rate at which the machine responds to the player by speeding up the machine through the deletion of prompts to the player. For example, in a game of poker, once an initial hand has been dealt, there may be a prompt that instructs the player to improve his hand by discarding and receiving new cards. This prompt could be deleted as one way of both keeping pace with the player and not "dunning" the player with instructions that are too repetitive or redundant.

In use and operation, an individual will engage any of the first playing machines by making wagers and playing the game in a conventional manner. Once the player has qualified to play at the second gaming means or the second chance means, that player is allowed to make decisions with respect to effecting the outcome at the second chance means or the second gaming means either with respect to pecuniary involvement, outcome of prizes to be awarded or performances to be made, or all of the above.

Moreover, having thus described the invention, it should be apparent that numerous structural modifications and adaptations may be resorted to without departing from the scope and fair meaning of the instant invention as set forth hereinabove and as defined hereinbelow by the claims.

I claim:

1. A player interactive gaming device comprising:

a plurality of player interactive first chance means each having a plurality of outcomes, at least one second chance means coupled to said first chance means and having means to interact with all of said plural players who become eligible to partake in said second chance means based on qualifying via said first chance means, certain of said plurality of outcomes from said plurality of first chance means triggering an input to said second chance means.

2. The interactive gaming device of claim 1 wherein winning outcomes of said plurality of first chance means each have a ranking and certain of said winning outcomes qualify for said second chance means.

3. The interactive gaming device of claim 2 wherein the ranking of winning outcomes of said plurality of said first chance means each have a corresponding payout value.

4. The interactive gaming device of claim 3 wherein said second chance means has an outcome and an input, said input is driven by one of said plural players having qualified via said one player's said first chance means.

5. A player interactive gaming device comprising:

a plurality of player interactive first chance means having a plurality of outcomes, at least one second chance means, said plurality of outcomes from said plurality of first chance means includes at least one outcome which serves as an input to enable said second chance means.

6. The interactive gaming device of claim 5 wherein said plurality of outcomes of said plurality of first chance means each has a ranking.

7. The interactive gaming device of claim 6 wherein said second chance means has an outcome correlative to the ranking of outcomes of said plurality of said first chance means.

8. The interactive gaming device of claim 7 wherein the ranking of outcomes of said plurality of said first chance means each have a corresponding payout value.

9. The interactive gaming device of claim 8 wherein the ranking of outcomes of said plurality of said first chance means are weighted relative to the respective corresponding payout value.

10. The interactive gaming device of claim 9 wherein said second chance means has an outcome whose input is driven by the weighted ranking of outcomes of said plurality of said first chance means.

11. The interactive gaming device of claim 5 wherein said second chance means, when enabled, poses chance related choices to a player who has qualified to play said second chance means via said first chance means.

12. A player interactive gaming device, comprising in combination:

a plurality of gaming machines, said gaming machines electronically coupled together;

each said gaming machine having a first gaming event;

a second gaming event electronically coupled to said plurality of gaming machines;

means to qualify to play said second gaming event by playing at least one of said plurality of gaming machines.

13. The interactive gaming device of claim 12 further including a first means of determining a qualifying outcome of said first gaming event for each of said plurality of gaming machines.

14. The interactive gaming device of claim 13 wherein each of said plurality of gaming machines includes a first display for displaying said first gaming event.

15. The interactive gaming device of claim 14 wherein said second gaming event includes a second display.

16. The device of claim 15 wherein said first and second games are different.

17. A gaming system comprising in combination:

a plurality of first gaming machines each controlled in their respective outputs by a random number generator means, a second gaming machine coupled to each of said first gaming machines and enabled by any of said first gaming machines upon the occurrence of enabling conditions determined by said random number generator means, and said random number generator means coupled to said second gaming machine to determine the outcome of said second gaming machine.

18. An interactive gaming device comprising, in combination:

a plurality of gaming machines;

a random number generator operatively coupled to said gaming machines developing outputs dependent upon choices made by a plurality of gaming machine players;

means to vary the speed of each said gaming machines to match the speed of the respective player.

19. An interactive method for altering game play speed of a gaming device, the steps including;

establishing a base rate for the gaming device by measuring any interval between when the device responds to the player and when the player responds back to the device;

determining whether the interval is substantially constant;

altering the base rate if the interval is not constant and then measuring the player's subsequent response interval;

determining whether the player's subsequent response interval is constant;

continuing to alter the base rate until the player's response interval is substantially constant.

20. The method of claim 19 wherein the altering of the base rate increases the device game play speed.

21. The method of claim 19 wherein the altering of the base rate decreases the device game play speed.

22. The method of claim 19 wherein the altering of the base rate occurs by deleting prompts to the player.

23. An interactive gaming method, the steps including:

placing a wager, playing a first game having a random outcome, and playing a second game only if the outcome of the first game qualifies for the second game, wherein playing the second game requires selecting a mine cart to enter into a mine shaft.

* * * * *